US005118267A

United States Patent [19]

Dollhopf

[11] Patent Number: 5,118,267

[45] Date of Patent: Jun. 2, 1992

[54] SPINNING PUMP HAVING AN ADAPTER WITH A RADIAL GROOVE

[75] Inventor: Rüdiger Dollhopf, Herbolzheim, Fed. Rep. of Germany

[73] Assignee: Rhone-Poulenc Rhodia Aktiengesellschaft, Freiburg, Fed. Rep. of Germany

[21] Appl. No.: 664,367

[22] Filed: Mar. 4, 1991

[30] Foreign Application Priority Data

Mar. 13, 1990 [DE] Fed. Rep. of Germany ..... 4007858

[51] Int. Cl.[5] ..... F04C 2/14

[52] U.S. Cl. ..... 418/181; 418/133; 418/270; 285/368; 277/206 R

[58] Field of Search ..... 418/181, 270, 196, 133; 285/368, 412; 403/337; 277/206 R, 236

[56] References Cited

U.S. PATENT DOCUMENTS

| | | | |
|---|---|---|---|
| 1,968,110 | 7/1934 | Walker | 123/193 CH |
| 3,123,012 | 3/1964 | Gilreath | 418/196 |
| 3,627,455 | 12/1971 | Nasvytis | 418/196 |
| 4,080,121 | 3/1978 | Goloff et al. | 418/53 |
| 4,477,087 | 10/1984 | Sutter, Jr. et al. | 277/206 R |
| 4,530,526 | 7/1985 | Dopyfra et al. | 285/368 |
| 4,767,138 | 8/1988 | Schafbuch | 285/368 |

*Primary Examiner*—Richard A. Bertsch

*Assistant Examiner*—David L. Cavanaugh

*Attorney, Agent, or Firm*—Bucknam and Archer

[57] ABSTRACT

A spinning pump (1) connected to a spinning pump block (2) by means of fastening screws (3) comprises a base plate (4) in contact with the connection face (11) of the spinning pump block (2), one or more gear plate (5), a cover plate (6), a drive shaft (7), an inlet channel (8) as well as outlet channels (9) for the spinning fluid, the channels (8, 9) are aligned with corresponding channels of the spinning pump block (2). The fastening screws (3) traverse through passage bores (12) an adapter part (15) connected with the cover plate (6) as well as plates (6,5,4) and are screwed into threaded bores (13) in the spinning pump block (2). The adapter part (15) has a groove (16) disposed parallel to the contact plane of base plate (4) and connection face (11), the depth of the groove being at least so great that the passage bores (12) lie in the region of the groove (16), and is at most so great that the outer limiting line or lines of the projection of the remaining area of the adapter part (15) lying in the plane of groove (16) embraces or embrace, in the plane in which lie the contact points of base plate (4) and connection face (11), the intersections of the inlet and outlet channels (8,9) with that plane. The spinning pump (1) permits a good seal at the contact face of base plate (4) and connection face (11) also at high melt pressure.

4 Claims, 1 Drawing Sheet

SPINNING PUMP HAVING AN ADAPTER WITH A RADIAL GROOVE

BRIEF SUMMARY OF THE INVENTION

The invention relates to a spinning pump which is coupled with a spinning pump block by means of symmetrically arranged fastening screws, with A. The spinning pump comprising essentially
   a. a base plate,
   b. one or more gear plates connected with the base plate and having gear wheels rotatable therein,
   c. a cover plate connected with the gear plates,
   d. a drive shaft for the gear wheels and
   e. an inlet channel or several inlet channels as well as an outlet channel or several outlet channels for the spinning fluid which lead through the base plate into the gear plates and are aligned with corresponding channels of the spinning pump block, B. the base plate of the spinning pump and the connection face of the spinning pump block making contact and the contact points lying in one plane, and C. the fastening screws engaging through the cover plate, the gear plates and the base plate through passage bores and engaging into threaded bores in the spinning pump block.

Known spinning pumps are used in the chemical fiber industry in the production of filaments from solutions or melts of a variety of substances, such as a solution of cellulose acetate in acetone, or melts of polyesters, e.g. polyethyleneterephthalate, or of polyamide, e.g. Polyamide-66.

When spinning a solution, such as the above mentioned solution of a cellulose ester in a volatile solvent, this solution, the spinning fluid, is conveyed under a pressure of for instance 20 bars through an inner inlet channel of the spinning pump block and the corresponding inner channel, aligned therewith, of the spinning pump, into the gear plate or plates of the spinning pump, is there passed between the teeth of meshing gears, and thereafter supplied to the spinning pump block again under a pressure of for instance 85 bars through the inner outlet channels of the spinning pump which are aligned with corresponding inner channels of the spinning pump block. Since the pressures to be applied are relatively low, there is no problem in holding the spinning pump, the plates of which are screwed together, thus forming a unit, and the spinning pump block together correctly (pressing them together) with the aid of fastening screws, so that a good seal exists at the face where the base plate of the spinning pump and the connection face of the spinning pump block make contact, for optimum seal the faces of the spinning pump and spinning pump block to be pressed together being usually lapped.

In melt spinning, the procedure is in principle the same, but substantially higher pressure must be applied for conveying the spinning fluid, that is, the melt, because the melts have a relatively high viscosity. In such a case, the pressure of the melt in the inlet channel may be e.g. 40 bars and in the outlet channels e.g. 300 bars. When such high pressures are applied, it is difficult, however, using the fastening screws, to press the spinning pump and the spinning pump block together for proper seal at the faces where the base plate of the spinning pump and the connection face of the spinning pump block make contact. With the older, rectangular and relatively high spinning pumps this difficulty was not yet crucial, since with them it was possible, due to their relatively high bending rigidity and the relatively small contact face between the base plate of the spinning pump and the spinning pump block, to achieve a sufficient seal, if not optimum, for ordinary operation.

The above described seal problem has caused serious difficulties, however, since the introduction of the new spinning pumps, namely the planet gear pumps sold, among others, by the firm BARMAG BARMER MASCHINENFABRIK AG, 5630 Remscheid 11, Federal Republic of Germany. Such a planet gear pump, which is a round model, has, as compared with the older rectangular spinning pumps, inter alia a considerably reduced height, less bending strength, and a much larger area of its base plate coming in contact with the spinning pump block.

When such a planet gear pump is connected with the spinning pump block by means of the fastening screws, the screw tightening forces are introduced, as the system requires, near the outer edge, and in the vicinity of the passage bores they lead to a slight, elastic material compaction, which in turn brings about a slight flexure, (initial flexure of the spinning pump plates, cover plate, gear plate, base plate). Thus there forms between the base plate of the spinning pump and the connection face of the spinning pump block a small cavity, in which the inlet channel and the outlet channels for the spinning fluid of the spinning pump and the corresponding channels of the spinning pump block end so that they are interrupted instead of being, as desired, in direct connection with one another. When the spinning installation is used in operation, melt penetrates into the formed cavity, and by the high pressure of this melt the already existing hereinabove mentioned flexure is considerably increased, with the result that there is a reduction of the area of material compaction in the vicinity of the passage bores. From a certain flexure of the spinning pump plates, melt issues from the spinning pump in the region between the fastening screws. Increasing the screw-tightening forces does not lead to an improvement of the seal between the base plate of the spinning pump and the connection face of the spinning pump block, as it can readily be concluded from the above described mechanism, namely:

screw forces

↓ local material compaction

↓ initial flexure and melt pressure

↓ further flexure

-continued

↓ leak

No improvement of the above mentioned seal is achieved by increasing the number of fastening screws or by increasing the area pressure by reducing the contact area of the base plate of the spinning pump and the spinning pump block or by using flat seals between the base plate of the spinning pump and the spinning pump block.

It is, therefore, the object of the invention to provide a spinning pump of the type mentioned hereinabove which in use permits such a good seal at the face where the base plate of the spinning pump and the connection face of the spinning pump block make contact that even when highest pressures of the spinning fluid are applied, no emergence of this fluid from the inlet and/or outlet channels in the region of that face can occur. Thus, not only spinning fluid must not be able to issue from the spinning pump itself, but also spinning fluid in the region of the connection of the spinning pump and spinning pump block, must not be able to flow from channel to channel, with shortcircuit flow of the spinning fluid between the channels.

Starting with a spinning pump of the type described hereinabove, this problem is solved in that an adapter part detachably connected with the cover plate of the spinning pump and having a bore for the drive shaft is provided, with the fastening screws engaging also through the passage bores in the adapter part, and the adapter part has a groove disposed parallel to the plane in which lie the contact points of the base plate of the spinning pump and the connection face of the spinning pump block, the depth of the groove being at least so great that the passage bores in the adapter part through which the fastening screws engage, lie in the region of the groove, and at most so great that, in the plane in which lie the contact points of the base plate of the spinning pump and the connection face of the spinning pump block, the outer limiting line or lines of the projection of the remaining area of the adapter part lying in the plane of the groove embrace the intersections of the inlet and outlet channels with that plane.

The invention is based on the following principle:

The flux of force generated by the fastening screws is deflected within the adapter part so that it becomes operative in the smaller region of the spinning pump, in which the spinning fluid flows usually predominantly in the center, that is, where the hydraulic forces acting on the basis of the pressure of the spinning fluid could engage and produce a flexure as described above.

By this introduction of forces, a material compaction of the spinning pump in the region of the fastening screws is prevented and the initial flexure of the spinning pump plates is thus avoided. The result achieved according to the invention therefore is that between the base plate of the spinning pump and the spinning pump block now only the very small area through which the spinning fluid is conveyed through the inlet and outlet channels is available for the hydraulic forces of the spinning fluid;

the hydraulic forces of the spinning fluid and the forces introduced by the fastening screws in the same area counteract each other, so that flexure of the spinning pump plates does not occur.

The invention has the following advantages:

Such a good seal is achieved at the face where the base plate of the spinning pump and the connection face of the spinning pump block make contact that not only no spinning fluid can issue from the spinning pump itself, but also no shortcircuit flow of the spinning fluid can occur between inlet and/or outlet channels. As a result, especially of the latter, a high thread titer precision from filament to filament is obtained with reference both to one spinning pump and to several spinning pumps relative to each other.

By the arrangement of the groove in the adapter part, in addition, a uniform introduction of forces into the spinning pump, upon tightening of the fastening screws, is ensured. This is due to the fact that the adapter part rests on the cover plate of the spinning pump with its full surface, i.e. with a face which, while being parallel to the groove plane, does not lie in this groove plane. A similar screw force introduction into the spinning pump as with the invention would indeed be possible; the adapter part needed for that purpose and not comprised by the invention would then have, instead of a groove, a shoulder on the contact side to the spinning pump. With such an adapter part, however, a tilting moment would result when the first fastening screw is tightened, which under favorable geometric conditions, would lead to an uneven introduction of forces. According to the invention, however, a tilting down of the adapter part is not possible because, as has been pointed out, with the tightening of the first fastening screw the adapter part is supported on its full surface by its bearing contact and therefore there is no tilting edge. The depth of the groove is at most so great that the outer limiting line or lines of the projection of the remaining area of the adapter part lying in the plane of the groove embrace, not only in the plane in which lie the contact points of the base plate of the spinning pump and connection face of the spinning pump block, the intersections of the inlet and outlet channels with that plane, but embrace also in the planes of the gear plate or plates which are intersected by the axes of the gear wheels and which are parallel to the plane in which lie the contact points of the base plate of the spinning pump and the connection face of the spinning pump block, the intersections of the axes of the gear wheels with those planes of the gear plate or plates. In this manner, a uniform load on the various plates of the spinning pump is achieved, resulting in a constant delivery precision of the spinning fluid. In addition, this embodiment makes it possible, also when very high pressures of the spinning fluid are applied, to reduce the axial gear tolerances, that is the axial play between gear and gear plate, so that leaks of spinning fluid in the gear plate are avoided or at least reduced and as a result a high titer constance among the filaments, that is, from filament to filament, during the entire operating time of a spinneret cycle is achieved. For the - force-locking - coupling of the spinning pump with the spinning pump block, cap screws may be used, for instance as fastening screws.

The fastening screws extend through passage bores in the adapter part as well as in the cover plate, the gear plate or plates, and the base plate of the spinning pump.

These passage bores permit preferably a slight play between the bore walls and the fastening screws. The fastening screws are screwed into internally threaded bores in the spinning pump block.

As material for the adapter part, the various plates of the spinning pump and the spinning pump block preferably a hardened steel is used.

BRIEF DESCRIPTION OF THE DRAWING

A practical example of the subject of the invention is explained more specifically herein below with reference to the drawing, FIG. 1 which shows schematically a spinning pump according to the invention.

Figure 1:
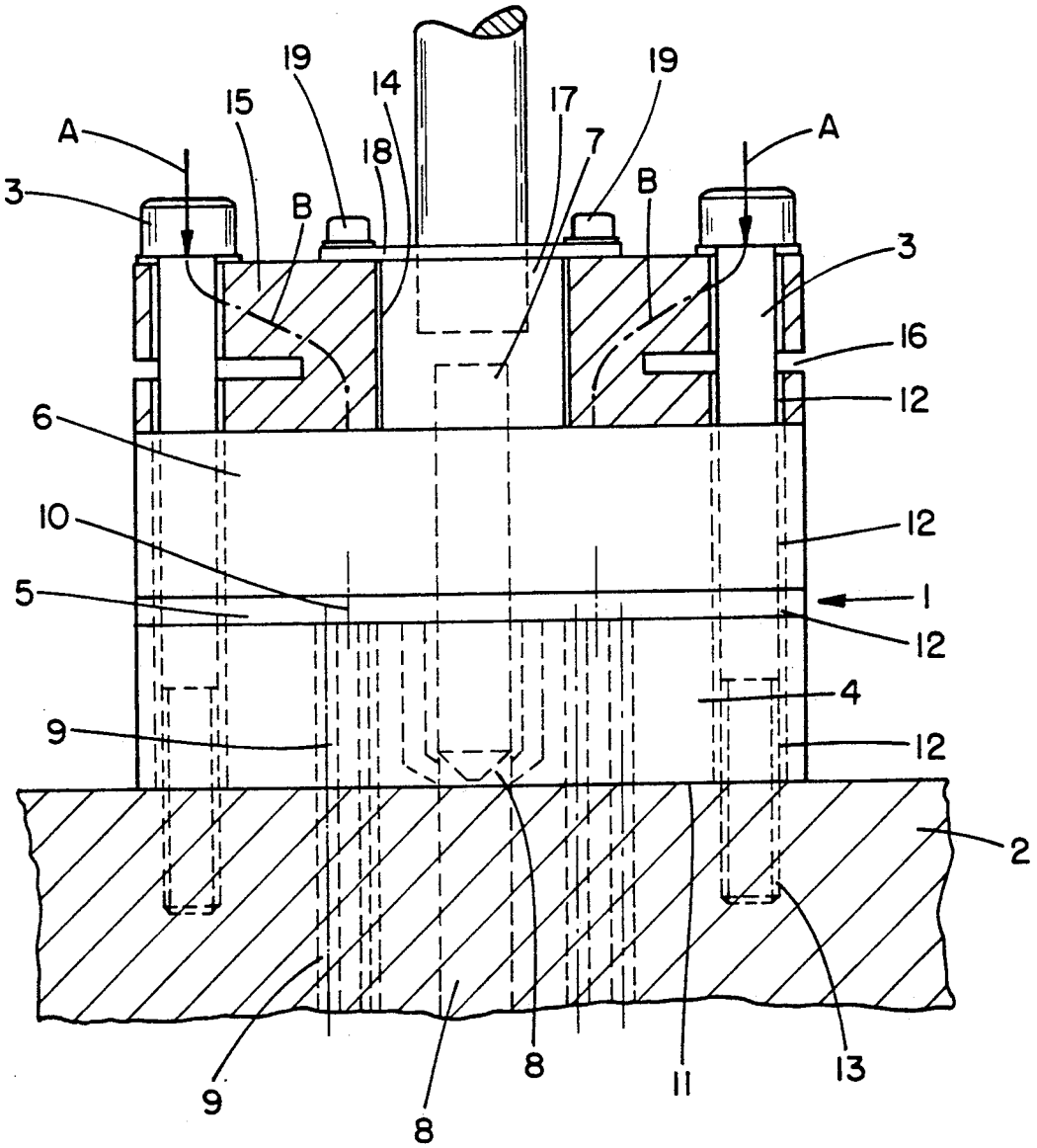
In FIG. 1 is illustrated a spinning pump 1 according to the invention, which is force-lockingly coupled with a spinning pump block 2 by means of three symmetrically arranged fastening screws 3. The spinning pump 1 consists of a base plate 4, a gear plate 5 connected with the base plate 4, in which are rotatably mounted a central drive gear as well as four driven gears disposed in planet fashion, a cover plate 6 connected with the gear plate 5, and a drive shaft 7 leading through the cover plate 6 and the gear plate 5 into the base plate 4, for the gear wheels.

The base plate 4, gear plate 5 and cover plate 6 of the spinning pump 1 are made of hardened steel and are joined together by means of screws—not shown in FIG. 1. Further the spinning pump 1 has an inner inlet channel 8 and four inner outlet channels 9 for the spinning fluid which lead through the base plate 4 into the gear plate 5. The inlet channel 8 leading through the base plate 4 into the gear plate 5 is aligned with the inlet channel 8 of the spinning pump block 2, and the outlet channels 9 leading through the base plate 4 into the gear plate 5 are aligned with the respective outlet channels 9 of the spinning pump block 2.

The spinning pump block 2 is also made of hardened steel.

The spinning pump 1 is a round model, i.e. its form is essentially cylindrical. The spinning pump 1 has a diameter of 92 mm. The base plate 4 of the spinning pump 1 and the connection face 11 of the spinning pump block 2 make contact and the contact points lie in one plane.

The three fastening screws 3, formed as cap screws, lead through three passage bores 12 into the cover plate 6, gear plate 5 and base plate 4 of the spinning pump 1. The passage bores 12 permit a play of 0.5 mm between the walls of the passage bores 12 and the fastening screws 3. The fastening screws 3 are screwed into internally threaded bores 13 in the spinning block 2.

An adapter part 15 is provided on the cover plate 6 of the spinning pump. This adapter part 15, also made of hardened steel, has a bore 14 for the drive shaft 7. In bore 14, of appropriate form, there is further arranged a coupling 17 for the connection of the drive shaft 7 with a drive unit. For axial fixation of coupling 17, a holding plate 18 connected with the adapter part 15 by means of screws 19, is further arranged on the side of the adapter part 15 away from the spinning pump 1. The adapter part 15, like the spinning pump 1, is essentially of cylindrical design; the diameter of the adapter part 15 corresponds to the diameter of the spinning pump 1. The adapter part 15 has also three passage bores 12, through which the three fastening screws 3 engage. Here too, a play of 0.5 mm between the walls of the passage bores and the fastening screws is provided. The adapter 15 further has a peripheral groove 16 of constant depth, this groove 16 being disposed parallel to that plane in which lie the contact points of the base plate 4 of the spinning pump 1 and the connection face 11 of the spinning pump block 2.

Groove 16 is so deep that the three passage bores 12 in the adapter part 15 through which the three fastening screws 3 lead, lie in the region of this groove 16. In other words, the groove plane is intersected by the passage bores 12 so that these intersections lie entirely in the groove zone, and also the outer limiting line of the projection of the remaining area of the adapter part 15 lying in the plane of groove 16 (as stated hereinabove, this outer limiting line forms a circle with a diameter of 54 mm) in the planes of the gear plate 5 which are intersected by the axes of 10 of the gear wheels, and which lie parallel to the plane in which lie the contact points of the base plate 4 of the spinning pump 1 and connection face 11 of the spinning block 2, embraces the intersections of the axes 10 of the gear wheels with those planes of the gear plate 5.

To express the matter in simpler words, although not quite so exactly: the three passage bores 12 lie within the region of groove 16 and the inlet channel 8, the outlet channels 9 as well as the axes 10 of the gear wheels lie within the region of the adapter part 15 not embraced by the groove 16.

Finally, the arrows A shown in FIG. 1 and the dashed lines B show the direction and the path of the force flux generated by the fastening screws 3.

Further there applies for the embodiment example: The depth of the groove 16 is 19 mm; the width of the groove 16 is 3 mm. The bore 14 in the adapter part 15, for the drive shaft 7 and the coupling 17, is round and is arranged passing centrically through the adapter part 15 and it has a diameter of 30.6 mm. The adapter part 15 has a height of 27 mm, and the groove 16 is at a distance of 10 mm from the screw-on face of the adapter part 15 to the cover plate 6 of the spinning pump 1. The inner diameter of groove 16 is 54 mm. The round and symmetrically arranged passage bores 12 in the adapter part 15, which have an inner diameter of 13 mm, lie on a centrically arranged perforation circle of a diameter of 71 mm.

The above described spinning pump was used for the melt spinning of Polyamide-66. The three fastening screws used for connecting the spinning pump with the spinning pump block were M12 screws; the tightening torque of these three screws was 100 Nm. The pressure of the Polyamide-66 melts was in the inlet channel 40 bars and in the four outlet channels initially 300 bars, but in the course of operation, the pressure of the Polyamide-66 melts in these outlet channels rose to 500 bars.

During an operating and observation period of 6 weeks, no Polyamide-66 melt whatever issued from the spinning pump, that is, in the zone where the base plate of the spinning pump and the connection face of the spinning pump block make contact. After the observation period of 6 weeks, the spinning pump was removed, i.e. the fastening screws were released and the spinning pump was taken off the spinning pump block. It was also found that no shortcircuit flow of Polyamide-66 melt between the channels in the region of the connection of spinning pump and spinning pump block had taken place. Further, the Polyamide-66 filaments spun with the aid of the spinning pump, showed a very high titer precision among themselves.

This invention clearly is not limited to a round spinning pump but can be applied to spinning pumps of any model.

What is claimed is:

1. A spinning pump which is force-lockingly coupled with a spinning pump block (2) by means of symmetrically arranged fastening screws (3), A. comprising a. a base plate (4), b. at least one gear plate (5) connected with the base plate, in which gear wheels are rotatably arranged, c. a cover plate (6) connected with at least one said gear plate;

d. a drive shaft (7) for the gear wheels and e. at least one inlet channel (8) and at least one outlet channel (9) for the spinning fluid which lead through the base plate into said at least one gear plates and are aligned with corresponding channels of the spinning pump block, B. the base plate (4) of the spinning pump and the connection face of the spinning pump block making contact and the contact points lying in one plane and C. the fastening screws (3) engaging through the cover plate, through said at least one gear plate and through said base plate through passage bores (12) and engaging in threaded bores (13) in the spinning pump block, D. an adapter part (15) detachably connected with said cover plate (6) of the spinning pump (1), said adapter part having a bore (14) for said drive shaft (7), said passage bores (12) extending through said adapter part, said fastening screws (3) engaging also through said passage bores (12) in the adapter part (15), the adapter part (15) having a groove (16) disposed parallel to the plane in which lie the contact points of the base plate (4) of the spinning pump (1) and connection face (11) of the spinning pump block (2), the depth of said groove being at least so great that the passage bores (12) in the adapter part (15) through which the fastening screws (3) engage lie in the region of the groove (16) and is at most so great that said at least one inlet and said at least one outlet channel (8,9) lie within the region of said adapter part (15) not embraced by said groove.

2. The spinning pump according to claim 1 wherein said gear wheels have axes (10) and said axes lie within the region of said adapter part not embraced by said groove.

3. The spinning pump according to claim 1 which is provided with a drive unit and wherein the bore (14) for said drive shaft (7) is formed so that it can receive also a coupling (17) for connecting said drive shaft (7) with said drive unit.

4. The spinning pump according to claim 2 which is provided with a drive unit and wherein the bore (14) for said drive shaft (7) is formed so that it can receive also a coupling (17) for connecting said drive shaft (7) with said drive unit.

* * * * *